United States Patent [19]

Androulakis

[11] 4,140,073

[45] Feb. 20, 1979

[54] THERMAL BARRIER SYSTEM FOR LIQUEFIED GAS TANK

[75] Inventor: John G. Androulakis, East Patchogue, N.Y.

[73] Assignee: Frigitemp Corporation, New York, N.Y.

[21] Appl. No.: 815,013

[22] Filed: Jul. 12, 1977

[51] Int. Cl.[2] ..... B63B 25/16

[52] U.S. Cl. ..... 114/74 A; 62/55; 220/901; 220/426

[58] Field of Search ..... 114/74 A; 220/9 LG, 220/DIG. 901, 426; 62/50, 55

[56] References Cited

U.S. PATENT DOCUMENTS

| | | | |
|---|---|---|---|
| 3,009,601 | 11/1961 | Matsch | 220/9 LG |
| 3,304,728 | 2/1967 | Haan | 62/50 X |
| 3,748,865 | 7/1973 | Laverman | 220/9 LG X |
| 3,770,158 | 11/1973 | Alleaume | 114/74 A X |
| 3,859,805 | 1/1975 | Johnson et al. | 114/74 A |

*Primary Examiner*—Trygve M. Blix
*Assistant Examiner*—Sherman D. Basinger
*Attorney, Agent, or Firm*—Morgan, Finnegan, Pine, Foley & Lee

[57] ABSTRACT

Heat barrier components and improved thermal insulation techniques are provided for an external tank insulation system of ships carrying liquefied natural gas, propane, ammonia, etc. Reduction of liquid boil-off rate or initial cost of insulation through the reduction of radiant heat leak is accomplished by a composite insulation system including a high reflectance component material on the external surface of insulation and/or interior surface of the ship facing the tank. Further, refrigeration in tank boil-off is used to cool a radiation shield located between the tank insulation and surrounding enclosure, and to cool the skirt support.

5 Claims, 13 Drawing Figures

THERMAL BARRIER SYSTEM FOR LIQUEFIED GAS TANK

BACKGROUND

This invention relates to an improved thermal insulation system for a cargo tank and support structure on board a ship transporting liquefied gas.

While large-scale ocean transport of liquefied gas, in particular liquid natural gas, is becoming a reality, the state of the art in tank insulation systems has not yet reached a satisfactory level in terms of both initial cost and thermal performance. Current engineering technology is principally limited to systems consisting of multi-layered polyurethane or polystyrene foam panels enclosed by an impervious to vapors membrane.

This system performs thermally well as resistance to solid conduction and interstitial gas convection is concerned. However, little consideration has yet been given to resistance to radiation which becomes the predominant mode of heat transfer from surroundings to the insulation system. See, for example, U.S. Pat. Nos. 3,748,865 and 3,828,709.

SUMMARY

Heat gain by radiation heat transfer, at the top of spherical tanks, is many times that transported by $N_2$ gas convection. In a vessel where the tank is close to the surrounding vessel structure, by decreasing the emittance value of the outer surface of the insulation and inner surface of the surrounding structure, each by a factor of 3, the radiation conductance is reduced by almost the same amount. Where the tank surface is not in close proximity to the ship structure, by decreasing the emittance of the outer surface of the insulation by a factor of 3, the radiation conductance is decreased by the same amount. The reduction in heat transferred by radiation will be followed by an increase in differential temperature between the outer surface of the insulation and the inner surface of the surrounding structure. The resulting increase of convective conductance is, however, small compared to the decrease of the radiative conductance.

The present invention may be characterized in summary as: A tanker vessel containing a tank for storing and transporting cryogenic fluids, said tank being supported in the vessel on a skirt member; a thermal barrier system comprising first high reflectance material disposed over the exterior surface of said tank, and second high reflectance material positioned between said first material and the interior surfaces of said vessel; high reflectance shield means positioned above the top of said tank; and means for circulating boil-off from said tank through said shield means and about said skirt.

DETAILED DESCRIPTION

Figure 1:
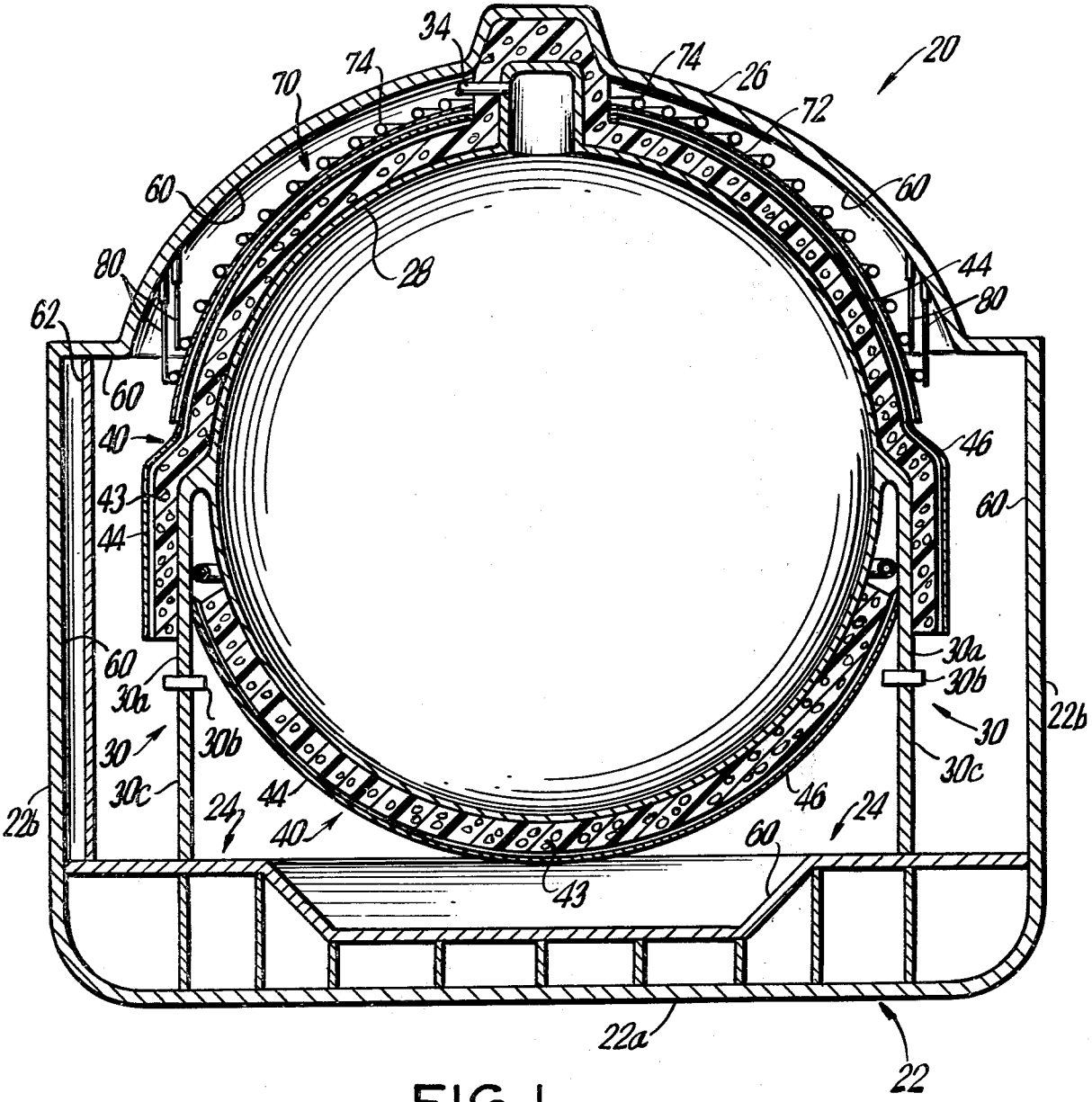
FIG. 1 is a transverse cross-sectional view of a ship and spherical LNG tank having a thermal barrier system of the present invention.

While this invention is susceptible of embodiment in many different forms, there is shown in the drawings and will hereinafter be described in detail a preferred embodiment of the invention, and modifications thereto, with the understanding that the present disclosure is to be considered as an exemplification of the principles of the invention and is not intended to limit the invention to the embodiments illustrated.

FIG. 1 illustrates in vertical cross-section a tanker vessel 20 for hauling cryogenic low pressure liquefied gas, for example liquefied natural gas (LNG) equipped with a thermal barrier system of the present invention. Vessel 20 includes a double hull 22 having an outer bottom **22*a* and outer sidewalls 22*b*, reinforcing inner bottom 24 (upper side ballast tanks not shown), and a top closure 26**. The vessel may also be of single skin construction.

The vessel 20 includes a plurality of spherical tanks 28 which are arranged in spaced apart longitudinal relationship (only one tank being illustrated). Each tank 20 is supported on the bottom 24 by a support skirt 30 of general cylindrical shape. The skirt 30 includes a first portion **30*a* integral with the tank 28 and extending downwardly from the equatorial ring of the tank. The material from which tank 28 and skirt portion 30*a*** are formed is compatible with cryogenic temperature and may be aluminum for example.

Skirt portion **30*a* is joined by a transition ring 30*b* to a lower skirt portion 30*c*. Skirt portion 30*c* is joined at its lower end to hull structure 24 and may be of similar material, for example carbon steel. Transition portion 30*b*** may be one of various constructions.

The cryogenic fluid within tank 28 is kept at or about atmospheric pressure and maintained at or below transition temperature to the gaseous state, e.g. for LNG −259° F. and 15 p.s.i.a. by allowing a small portion of the fluid to vaporize and thus remove heat energy from the tank. The vaporized fluid is referred to as boil-off and is removed by means of a vent 34 at the top of the tank. In the past, this boil-off has been vented to atmosphere and used for shipboard services, e.g. engine fuel.

The boil-off vapor, however, with increasing gas prices represents an increasingly costly loss during transit. The boil-off, since it is at low temperature, can be utilized as a refrigerant to control its loss.

Figure 2:
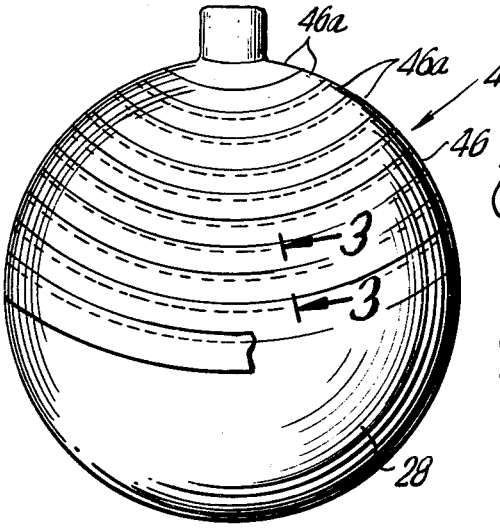
FIG. 2 is a schematic view illustrating the wrapping of superinsulation about a spherical tank.
Figure 3:
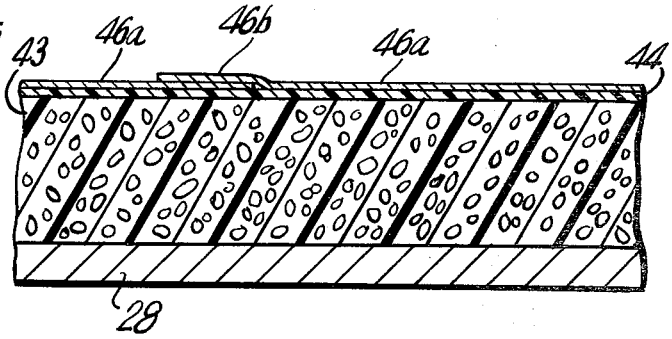
FIG. 3 is an enlarged cross-sectional view taken along line 3—3 in FIG. 2 and illustrating the superinsulation.

The thermal barrier system of this invention contemplates the reduction of convective, conductive, and radiant heat transfer to the tank to reduce and control boil-off. With particular reference to FIGS. 1–3, the exterior of the tank 28 is encapsulated in a composite insulation 40. Composite insulation 40 includes essentially an inner multi-layered part of rigid insulation 43 of polyurethane or polystyrene panels attached to the tank surface. Layer 43 is covered on its outer surface by a multi-coated vapor barrier membrane 44 of butyl/polyurethane elastomer, for example. Layers 43 are free of convective heat transfer and are preferably purged with nitrogen gas as is known in the art. The purging with nitrogen assures that water vapor in the atmosphere does not enter the inner layers and become exposed to the cryogenic temperatures of the tank.

An outer layer 46 of aluminum foil or aluminized plastic with the aluminum facing outwardly is positioned over the vapor barrier 44. The outer layer 46 is a radiation shield and may be perforated or unperforated aluminum foil or aluminized plastic or a blanket composed of several layers of aluminum foil or aluminized plastic. The blanket layers of these reflective materials may have fiberglass spacers interposed therebetween.

Alternatively, the high reflective layer 46 may be formed by coating vapor barrier 44 with a high reflective coating by painting or other deposition technique. The vapor barrier 44 may also be replaced with a high reflectance heat shield impermeable to water vapor or adding high reflectance additives to the vapor barrier material as it is being applied or manufactured.

FIG. 2 illustrates a wrapping technique utilized in positioning the radiation shield layer 46 of blanket or single foil construction about the spherical tank 28. Annular strips 46*a* of high reflectance material are wrapped about the tank starting from the top (or bottom in the case of the bottom section) and arranged along parallels. The annular strips overlap at one edge 46*b*, FIG. 3, to provide a bonding zone therebetween for adhesive or the like.

In the case of a single layer of foil, the junctions 46*b* may be made by using aluminum or aluminized plastic tape, or polyester and polyimide tapes sold by 3M, Tessa, CHR Co. and others. Wrapping may also be performed along the meridians.

Figure 4:
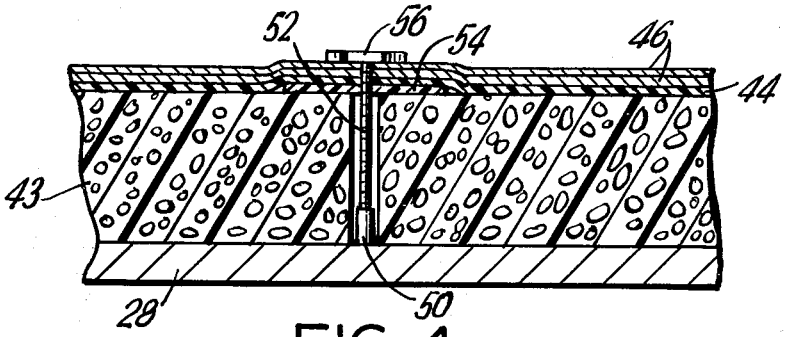
FIG. 4 is a cross-sectional view of an alternative superinsulation blanket.

In the case of a heavy reflectance blanket, FIG. 4 for example, where multiple layers 46 are used, it is preferable to secure the outer layers 46 directly to the tank 28. To this end, a threaded metal stud 50 is welded to the tank exterior. A plastic threaded rod 52 is threadably engaged in stud 50 and extends outwardly through holes in the layers of insulation. A first plastic nut 54 is threadably engaged on rod 52 and abuts insulation layer 43 below vapor barrier layer 44. A second plastic nut 56 is threaded on rod 52 and abuts against the outer surface of high reflectance layer 46. In this manner, all the insulation layers are attached to the tank and the loading of nut 56 assures a good seal of vapor membrane 44 betweet nut 56 and nut 54.

In addition to providing the high reflectance surface 46 on the tank 28, the interior surfaces of the vessel 60, FIG. 1, viewed by the tank should be coated with a high reflectance coating to further reduce radiant heat leaks. A coating of aluminum paint or the like will perform this function. Alternatively, a curtain 62 of high reflectance metal foil may be positioned between the tank and the vessel interior.

Further reduction of radiative heat gain is accomplished as follows: Spherical tanks have high radiation heat leaks through the top hemisphere. Since maximum heat leaks to the tank occur during sunny days, it is desirable to reduce the difference in boil-off rate between day and night by placing the radiation shield on the top hemisphere which is more sensitive to environmental changes.

To this end, a concave, semi-hemispherical radiation shield 70, FIG. 1, is positioned over the top of the tank 28 beneath the top 26 of the vessel. Shield 70 includes a high reflectance member 72 of aluminum, copper or stainless steel, on which is welded a cooling coil array 74 of tubing. Boil-off of cryogenic fluid is directed to the cooling path defined by tubes 74 through manifold 76. As the boil-off circulates through coils 74 it warms and removes heat from the shield. The warmed boil-off is removed from the cooling path through a manifold 78 and may be vented to atmosphere or stored for ship usage. The shield 70 is suspended from the underside of the roof 26 by means of plastic or other low conductivity rods 80.

Figure 5:
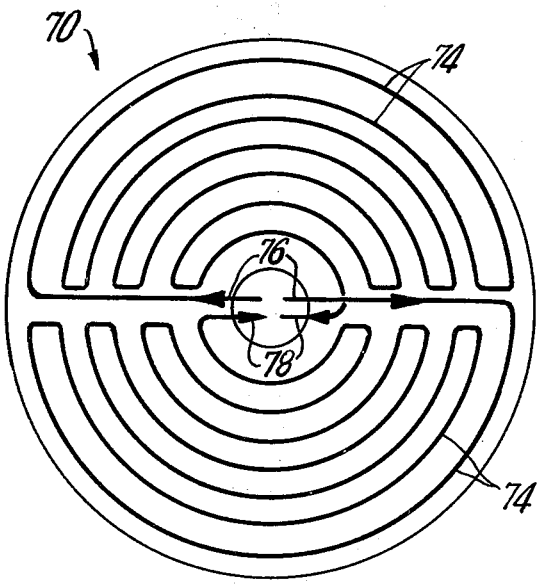
FIGS. 5 and 6 are schematic plane views illustrating different flow patterns for a vapor cooled radiation shield.
Figure 6:
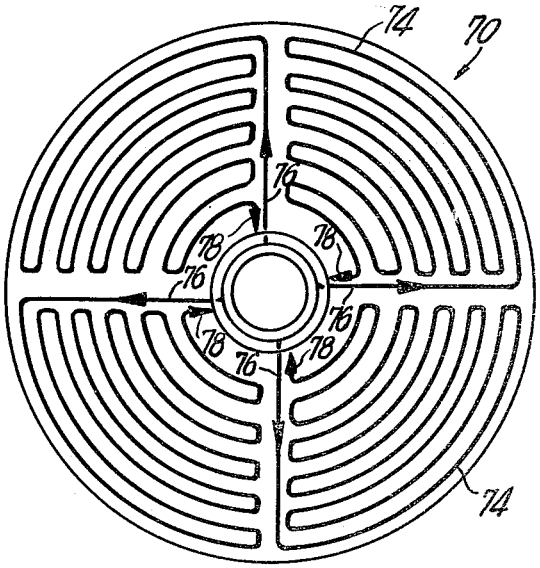

FIGS. 5 and 6 show two alternative cooling paths for the coils 74. The cooling path of FIG. 5 is a two stream system wherein each stream cools one half of the semi-hemisphere. The cooling path of FIG. 6 is a four stream system wherein each stream cools a quadrant of the semi-hemispherical shield 70. In each cooling path the boil-off from the tank is directed to the outermost coil first and is then routed back to the center through step wise parallel paths.

The tank insulation layers just described function to minimize radiation heat gain. There are, however, other heat gain sources including conduction through the tank skirt 30, and to a lesser degree, heat introduction through the nitrogen purge system in the insulation layers.

Heat is transported to and from the skirt which supports the tank by all three mechanisms; conduction (solid, gas), gas convection, and radiation. The boil-off may be used to control this heat transfer. However, two design criteria must be considered. These criteria are upper limit of heat transfer to the tank through the skirt and lower limit of temperature at the point where the skirt is connected to the ship structure. The temperature profile in the skirt determines the induced thermal stress in the skirt and in the tank at the point of junction with the skirt. On the other hand, heat leaks to the tank through the skirt are about one third of the total. Cold vapor, i.e. boil-off, may be used to cool the skirt in such a manner that heat gain is reduced and the temperature profile on the skirt is satisfactory.

The particular arrangement of skirt cooling varies depending upon these design criteria, the cryogenic liquid and the materials from which the skirt is fabricated. FIGS. 7–13 illustrate several approaches to boil-off skirt cooling.

Figure 7:
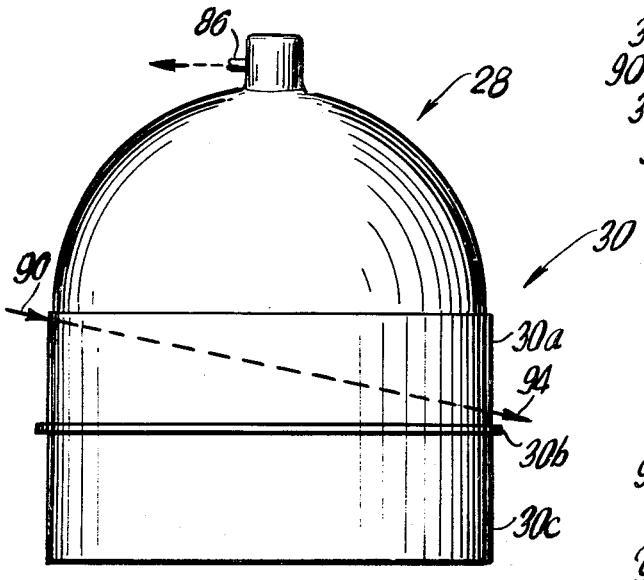
FIG. 7 is a schematic elevation view illustrating a boil-off coolant path around the support skirt of a tank.
Figure 8:
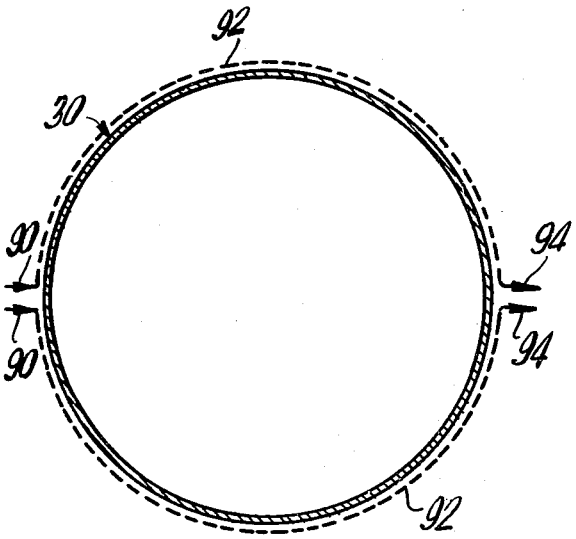
FIG. 8 is a plane view of the coolant path of FIG. 7.

With reference to FIGS. 7 and 8, boil-off from tank 28 is routed through conduit 86 to inlets 90 of a pair of coils 92 which are attached to and in thermal communication with skirt 30 at the upper skirt portion 30*a*. Each coil traverses 180° around and in a downwardly directed path (shown in dotted line) about the skirt. The boil-off is removed at the outlet 94 of each coil after a single pass. The boil-off removes heat from the skirt to control the heat transfer up and around the skirt.

Figure 10:
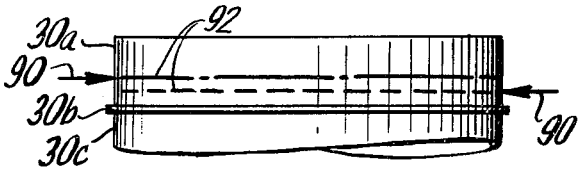
FIGS. 10 and 11 are fragmentary elevation and plan schematic views of an alternative skirt coolant path.
Figure 11:
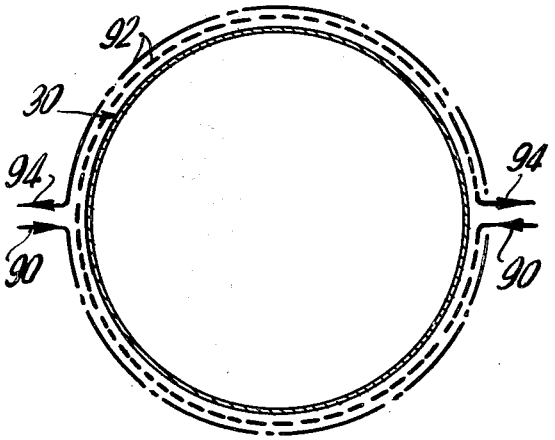

FIGS. 10 and 11 illustrate another cooling path wherein each coil 92 circumscribes the entire skirt in a horizontal path with the paths being spaced apart horizontally.

Figure 9:
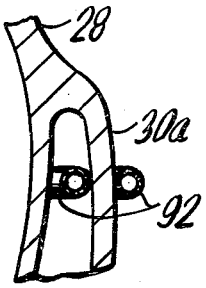
FIG. 9 is an enlarged, fragmentary, sectional view illustrating coolant coils interior and exterior to the skirt support.

The coils 92 may be positioned on the exterior or interior surfaces, or both, of the skirt as shown in FIG. 9.

Figure 12:
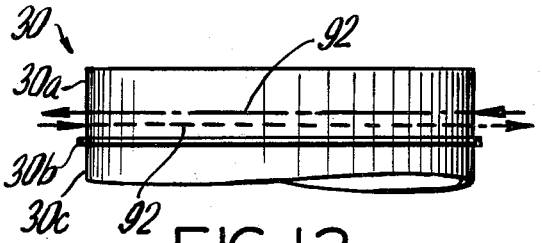
FIGS. 12 and 13 are fragmentary elevation and plan schematic views of still another skirt coolant path.
Figure 13:
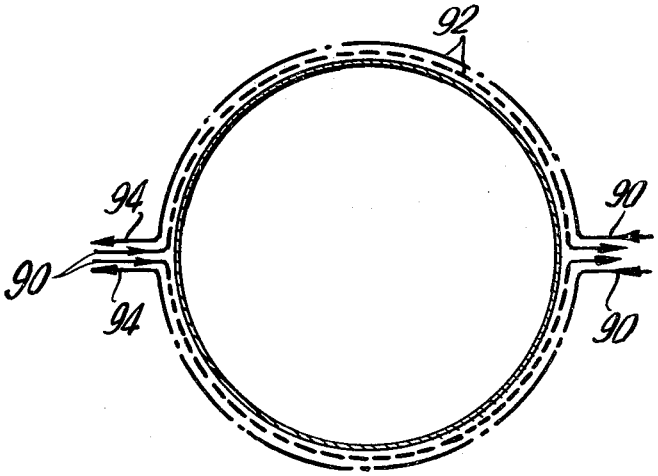

FIGS. 12 and 13 illustrate still another cooling path arrangement similar to that shown in FIGS. 10 and 11. In this embodiment four coils 92, two on each side of the skirt, traverse 180° of the skirt but in opposite or counter flowing directions. The heated vapor from the skirt coolant coils is either directed to cool a radiation shield of the type described above before being directed to the exhaust or directed to the exhaust to be used in the ship, stored in the ship or vented to the atmosphere. Also, the heated vapor can be used to pre-cool the $N_2$ purge gas by running the heated boil-off and $N_2$ through a conventional gas to gas counterflow heat exchanger. In this manner, the heat content of the $N_2$ may be reduced and thus reduce the heat added to tank 28 by the $N_2$ purge gas.

It is understood that the present invention is not limited to the foregoing described illustrative embodiment as modifications will be obvious to those skilled in the art without departure from the scope of the invention.

What is claimed is:

1. In a tanker vessel containing a tank for storing and transporting cryogenic fluids, said tank having exterior surface insulation thereon and being supported in the vessel on a skirt member; a thermal barrier system comprising high reflectance material positioned between the tank and the interior surfaces of said vessel; high reflectance shield means positioned above the top of said tank; and means for circulating boil-off from said tank about said shield means and about said skirt member.

2. A tanker vessel of claim 1, wherein said high reflectance material is aluminum foil.

3. A tanker vessel of claim 1, wherein said circulating means includes a plurality of coolant paths on said shield means.

4. A tanker vessel of claim 1, wherein said circulating means includes a plurality of coolant paths on said skirt member.

5. An LNG tanker containing a spherical tank for storing and transporting LNG, said tank being supported in said tanker on a skirt member wherein the improvement comprises high reflectance material positioned on the outer surface of said tank, and the inner surfaces of said tanker viewed by the tank having a high reflectance coating thereon; a hemispherical shield positioned above said tank; conduit means for directing boil-off from said tank into thermal contact with said shield and said skirt member, whereby heat is removed therefrom.

* * * * *